US007835905B2

(12) United States Patent
Kim

(10) Patent No.: US 7,835,905 B2
(45) Date of Patent: Nov. 16, 2010

(54) APPARATUS AND METHOD FOR DETECTING DEGREE OF VOICING OF SPEECH SIGNAL

(75) Inventor: Hyun-Soo Kim, Yongin-si (KR)

(73) Assignee: Samsung Electronics Co., Ltd (KR)

( * ) Notice: Subject to any disclaimer, the term of this patent is extended or adjusted under 35 U.S.C. 154(b) by 855 days.

(21) Appl. No.: 11/732,656

(22) Filed: Apr. 4, 2007

(65) Prior Publication Data

US 2007/0288233 A1 Dec. 13, 2007

(30) Foreign Application Priority Data

Apr. 17, 2006 (KR) ..... 10-2006-0034722

(51) Int. Cl.
*G10L 11/06* (2006.01)

(52) U.S. Cl. ..... 704/208; 704/207; 704/206

(58) Field of Classification Search ..... 704/200, 704/201, 203, 205, 206, 207, 208, 209, 210, 704/214, 215

See application file for complete search history.

(56) References Cited

U.S. PATENT DOCUMENTS

| | | | | |
|---|---|---|---|---|
| 5,189,701 | A * | 2/1993 | Jain | 704/207 |
| 6,018,706 | A * | 1/2000 | Huang et al. | 704/207 |
| 7,567,900 | B2 * | 7/2009 | Suzuki et al. | 704/233 |
| 2004/0133424 | A1 | 7/2004 | Ealey et al. | |
| 2004/0260540 | A1 | 12/2004 | Zhang | |

FOREIGN PATENT DOCUMENTS

| | | |
|---|---|---|
| JP | 10-097296 | 4/1998 |
| JP | 10-105194 | 4/1998 |
| JP | 10-124094 | 5/1998 |
| KR | 1998-037190 | 8/1998 |
| KR | 100347188 | 7/2002 |
| KR | 2003-0085354 | 11/2003 |
| KR | 100416754 | 1/2004 |

* cited by examiner

*Primary Examiner*—Huyen X. Vo
(74) *Attorney, Agent, or Firm*—The Farrell Law Firm, LLP

(57) ABSTRACT

In order to detect a degree of voicing of a speech signal, an input speech signal is converted to a speech signal in the frequency domain, a pitch value is calculated from the speech signal, a plurality of harmonic peaks existing in the speech signal are detected, and a difference obtained by comparing the pitch value to an interval between adjacent harmonic peaks among the detected harmonic peaks is detected as the degree of voicing included in the speech signal.

14 Claims, 8 Drawing Sheets

APPARATUS AND METHOD FOR DETECTING DEGREE OF VOICING OF SPEECH SIGNAL

PRIORITY

This application claims priority under 35 U.S.C. §119 to an application entitled "Apparatus and Method for Detecting Degree of Voicing from Speech Signal" filed in the Korean Intellectual Property Office on Apr. 17, 2006 and assigned Serial No. 2006-34722, the content of which is incorporated herein by reference.

BACKGROUND OF THE INVENTION

1. Field of the Invention

The present invention relates generally to speech signal processing, and in particular, to an apparatus and method for detecting a degree of voicing of a speech signal.

2. Description of the Related Art

A method of separating a speech signal, which is used to perform phonetic coding into a voiced and unvoiced sound can be divided into six categories, such as onset, full-band steady-state voiced, full-band transient voiced, low-pass transient voiced, low-pass steady-state voiced, and unvoiced, for phonetic segmentation. Features used for the voiced and unvoiced separation and are combined and used by a linear discriminator are low-band speech energy, zero-crossing count, first reflection coefficient, pre-emphasized energy ratio, second reflection coefficient, casual pitch prediction gains, and non-casual pitch prediction gains. As described above, there exist many features used for the separation and feature extraction of voiced and unvoiced sounds, however, since information is insufficient to separate the voiced and unvoiced sounds using a single feature for each of the voiced and unvoiced sounds, they are separated by combining several features. Thus, how to combine and use several features significantly affects the accuracy of the voiced and unvoiced separation.

However, since correlations between the features exist, when several features are combined, the correlations must be considered, resulting in severe performance degradation related to noise. In addition, the existence or not of a harmonic component, which is an essential difference between the voiced sound and the unvoiced sound, and a difference between harmonic degrees cannot be normally represented, and thus, a feature extraction method for correctly performing the voiced and unvoiced separation by analyzing the harmonic component is required.

In order to correctly estimate the degree of voicing, sensitivity of a voiced sound included in a speech signal, tone of pitches, smoothing variation of pitches, insensitivity of randomness of a pitch period, insensitivity of a spectrum envelope, and subjective performance must be considered.

SUMMARY OF THE INVENTION

An aspect of the present invention is to substantially solve at least the above problems and/or disadvantages and to provide at least the advantages below. Accordingly, an aspect of the present invention is to provide a method and apparatus for detecting a degree of voicing, whereby a voiced sound and an unvoiced sound can be separated by finding characteristics of the voiced sound and the unvoiced sound using a single feature without combining several unreliable features.

The prior art, does not handle or analyze information on harmonic component that is an essential difference between the voiced sound and the unvoiced sound. Another aspect of the present invention is to provide a method and apparatus for detecting a degree of voicing. Voiced information can be detected by using the correct and practical feature extraction method based on harmonic component analysis. Such analysis may use a method of extracting voiced and unvoiced separation information by analyzing the envelope ratio of harmonic peaks versus the remaining peaks and by excluding the harmonic peaks, i.e., non-harmonic peaks. Voiced information is most important and significantly performance-affected information in all systems, using speech and audio signals.

According to one aspect of the present invention, there is provided a method of detecting a degree of voicing of a speech signal, the method includes converting a received time domain speech signal to a frequency domain speech signal; calculating the pitch value from the speech signal; detecting the plurality of harmonic peaks existing in the speech signal; and detecting the difference value, which is obtained by comparing the distance between adjacent harmonic peaks among the detected harmonic peaks to the pitch value, as a degree of voicing indicating a ratio of a voiced sound included in the speech signal.

According to another aspect of the present invention, there is provided an apparatus for detecting a degree of voicing of a speech signal, the apparatus includes a frequency domain converter for converting a received time domain speech signal to a frequency domain speech signal; a pitch calculator for calculating the pitch value from the speech signal; a harmonic peak determiner for detecting the plurality of harmonic peaks existing in the speech signal; and a voicing degree detector for detecting the difference value, which is obtained by comparing the distance between adjacent harmonic peaks among the detected harmonic peaks to the pitch value, as a degree of voicing indicating the ratio of a voiced sound included in the speech signal.

BRIEF DESCRIPTION OF THE DRAWINGS

The above and other aspects, features and advantages of the present invention will become more apparent from the following detailed description when taken in conjunction with the accompanying drawing in which.

DETAILED DESCRIPTION OF THE PREFERRED EMBODIMENT

Figure 1:
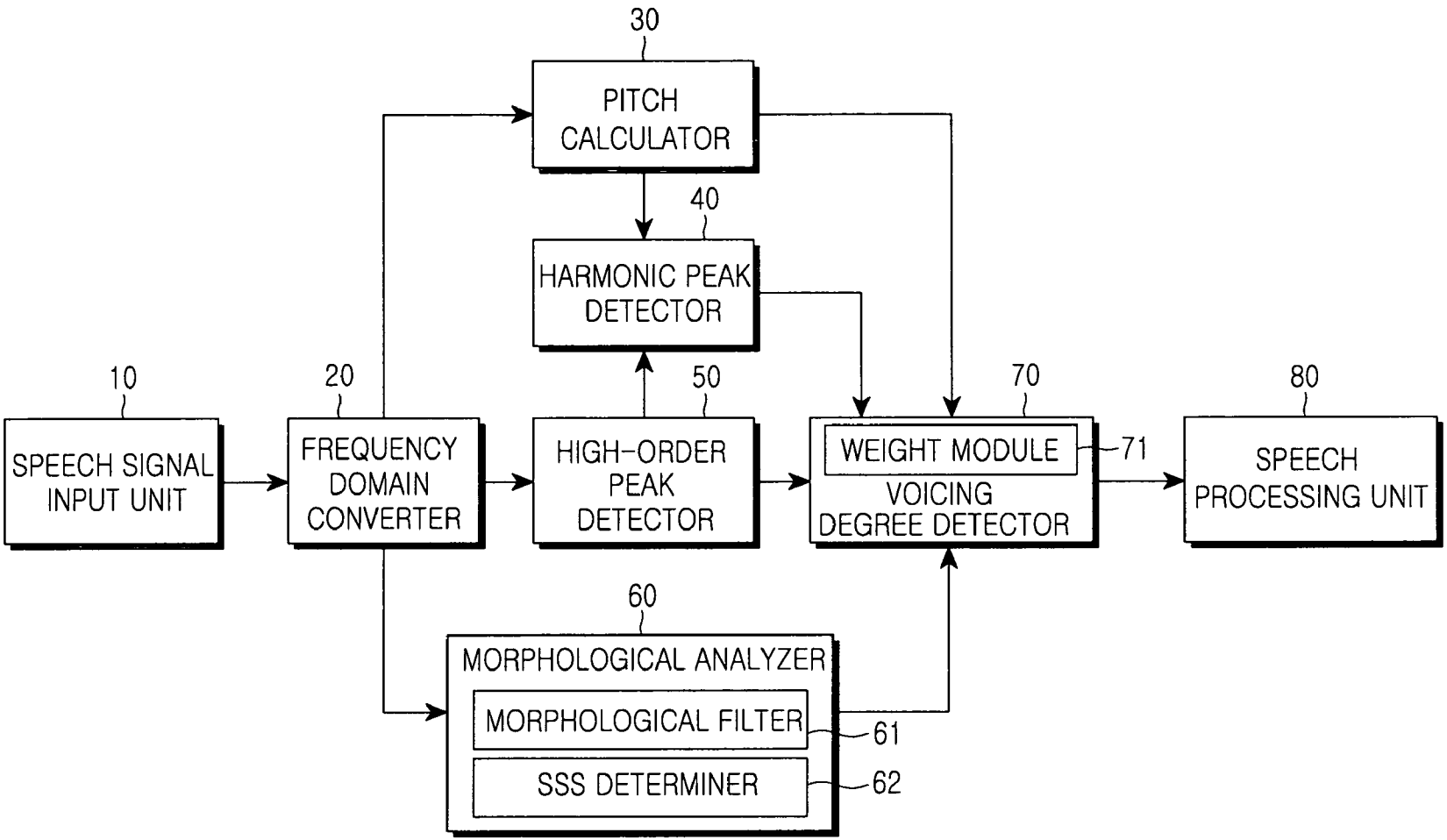
FIG. 1 is a block diagram of an apparatus for detecting the degree of voicing of a speech signal according to the present invention.

Preferred embodiments of the present invention will be described herein below with reference to the accompanying drawings. In the drawings, the same or similar elements are denoted by the same reference numerals even though they are depicted in different drawings. In the following description, well-known functions or constructions are not described in detail since they would obscure the invention in unnecessary detail.

The present invention provides a method and apparatus for detecting the degree of voicing of a speech signal. This is to detect not only features for conventional simple voiced and unvoiced separation but also the constant degree of voiced and unvoiced components, which is an essential characteristic of a speech signal, and to extract a very important characteristic in analyzing the speech signal.

Since voiced sound contains most speech energy due to much more power generated by the speech processing system, distortion of a part in which the voiced sound is included in a speech signal significantly affects the general sound quality of a coded speech.

Further, since interaction between glottal excitation and vocal tract in the voiced speech causes many difficulties in the spectral estimation approach, measurement information of the degree of voicing is requisite for most systems. Thus, it is very important to detect the actual degree of voicing in many applications. For example, the degree of voicing is used to form excitation in a decoder when sinusoidal speech coding is performed. In addition, the degree of voicing is also useful for speech recognition.

The present invention provides a method for the measurement of the degree of voicing, wherein the degree of voicing is obtained by measuring the degree of deviation from periodicity in the spectrum or temporal component of a speech signal.

Although there are many methods for measuring periodicity, a speech signal spectrum based analysis method is used in the present invention. A spectrum of a speech signal having a variety of amplitudes with strong voicing is formed by a set of harmonic peaks having a constant interval, and in the present invention, the degree of voicing is detected using deviation from this structure.

Referring to FIG. 1, the apparatus includes a speech signal input unit 10, a frequency domain converter 20, a pitch calculator 30, a harmonic peak detector 40, a high-order peak detector 50, a morphological analyzer 60, a voicing degree detector 70, and a speech processing unit 80.

Speech signal input unit 10 can include a microphone or a similar device, and receives a speech signal and outputs the received speech signal to frequency domain converter 20. Frequency domain converter 20 converts the input speech signal of a time domain to a speech signal of a frequency domain using Fast Fourier Transform (FFT) and outputs the converted speech signal to pitch calculator 30, harmonic peak detector 40, high-order peak detector 50, and morphological analyzer 60. At this time, the frequency domain converter 20 extracts and outputs a Short-Time Fourier Transform (SIFT) absolute value of the speech signal of the frequency domain.

High-order peak detector 50 detects existing peaks of predetermined duration of the input speech signal in the frequency domain, determines the order of peaks to be detected, determines high-order peaks corresponding to the determined peak order as harmonic peaks, and outputs the harmonic peaks to voicing degree detector 70. Since high-order peak detector 50 must detect the harmonic peaks from the speech signal, high-order peak detector 50 determines at least second order as the order of peaks to be detected.

Figure 2A:
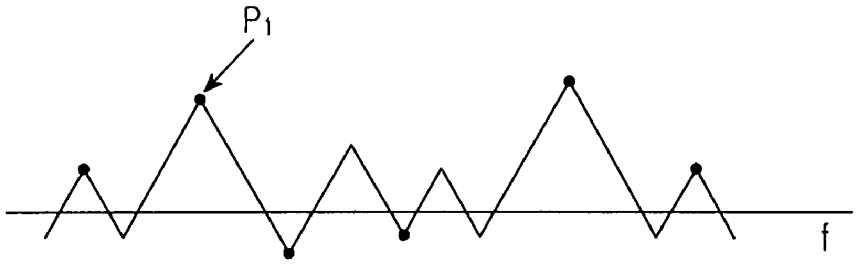
FIGS. 2A to 2C are reference diagrams for explaining how to obtain high-order peaks according to the present invention.
Figure 2B:
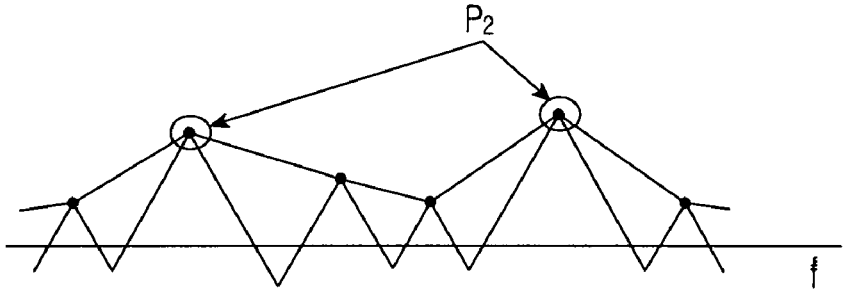
Figure 2C:
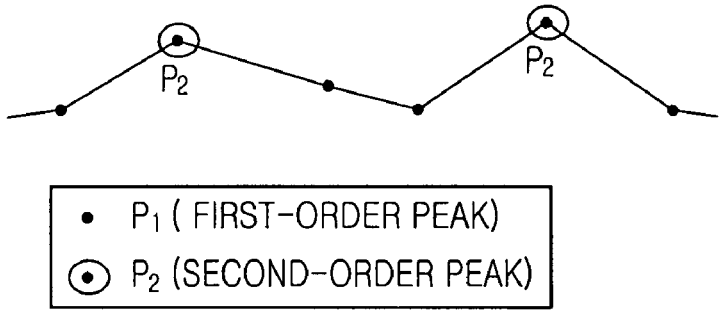

Generally when peaks used are first-order peaks, in the present invention, peaks in a signal formed with the first-order peaks are defined as second-order peaks. That is, peaks of the first-order are defined as second-order peaks, and likewise, third-order peaks are peaks in a signal formed with the second-order peaks. The high-order peaks are defined as described above. Thus, second-order peaks can be detected by reconfiguring first-order peaks in new time series and extracting peaks of the time series. FIGS. 2A to 2C are reference diagrams for explaining how to obtain high-order peaks according to the present invention. FIG. 2A shows first-order peaks P1. Peaks initially detected in an actual search range by harmonic peak detector 40 are the first-order peaks P1 illustrated in FIG. 2A. Peaks obtained when the first-order peaks Pi are connected as illustrated in FIG. 2B are defined as second-order peaks P2 as illustrated in FIG. 2C. In the present invention, the peaks selected as harmonic peaks by harmonic peak detector 40 at least second-order peaks. Although how to obtain second-order peaks is illustrated in FIGS. 2A to 2C, peaks between the second-order peaks P2 can be defined as third-order peaks, and in the same manner, up to $N^{th}$-order peaks can be defined where N denotes a natural number.

These high-order peaks can be used as very effective statistical values in feature extraction of a speech or audio signal. According to a characteristic of high-order peaks suggested in the present invention, higher-order peaks have a higher level and a lower frequency than lower-order peaks. For example, the number of second-order peaks is less than the number of first-order peaks. An existence rate of each-order peaks can be very useful in the feature extraction of a speech or audio signal, and in particular, second-order and third-order peaks have pitch extraction information. In addition, the numbers of sampling points or times of the second-order peaks and the third-order peaks have much information regarding the feature extraction of a speech or audio signal.

Rules of the high-order peaks are as follows.

1. Only one valley (peak) can exist between consecutive peaks (valleys).
2. The rule 1 is applied to each-order peaks (valleys).
3. High-order peaks (valleys) exist less than lower-order peaks (valleys) and exist in a subset of the lower-order peaks (valleys).
4. At least one lower-order peak (valley) always exists between any two consecutive high-order peaks (valleys).
5. High-order peaks (valleys) have a higher (lower) level in average than lower order peaks (valleys).
6. An order in which only one peak and one valley (e.g., the maximum value and the minimum value in one frame) exist for a specific duration (e.g., during one frame) of a signal.

The high-order peaks or valleys can be used as very effective statistical values in the feature extraction of a speech or audio signal, and in particular, second-order and third-order peaks have pitch information of the speech or audio signal. In addition, the numbers of sampling points or times of the second-order peaks and the third-order peaks have much information regarding the feature extraction of a speech or audio signal.

Pitch calculator 30 calculates a pitch value using the input speech signal of the frequency domain and outputs the calculated pitch value to harmonic peak detector 40 and voicing degree detector 70.

Harmonic peak detector 40 determines a peak search range using the input pitch value, sets the actual peak search range of the speech signal, detects the plurality of existing peaks in the set peak search range and the spectral value corresponding to each peak, and determines the peak having the highest spectral value among the detected peaks as a harmonic peak. Various conventional methods can be used to detect the plurality of peaks existing in the set peak search range. For example, when the value of a previous point is less than the value of a certain point and the value of a subsequent point is also less than the value of the certain point, or when slopes before and after the certain point are changed from + to −, the certain point is a peak.

Figure 3:
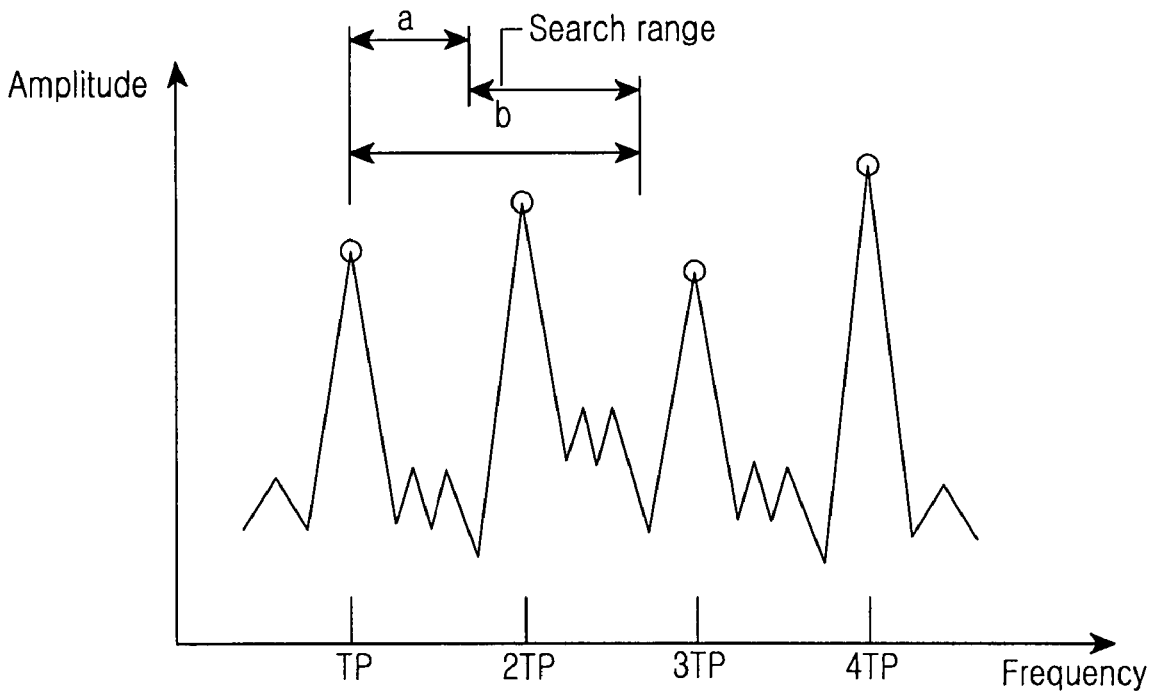
FIG. 3 shows a harmonic peak search range according to the present invention.

The peak search range is determined using the pitch value input from pitch calculator 30. The peak search range is a range that is predicted for a harmonic peak of the speech signal to exist therein and is illustrated in FIG. 3. FIG. 3 illustrates a harmonic peak search range according to the present invention. As illustrated in FIG. 3, the peak search range includes a shifting range a and a search range b obtained by excluding the shifting range a from a total range. The shifting range a is a range in which peak detection is not performed by harmonic peak detector 40 on the speech signal; the search range b is a range in which the peak detection is performed by harmonic peak detector 40 on the speech signal; the total range and the shifting range a can be dynamically set according to the state of the speech signal. Thus, a decrease of the number of actual peak search ranges can cause a decrease of the amount of computation of harmonic peak detector 40.

Harmonic peak detector 40 can detect harmonic peaks from a beginning point of the speech signal to the end of the bandwidth of the speech signal by setting the peak search range from the beginning point of the speech signal when initially detecting a harmonic peak from the input speech signal and continuously setting the peak search range based on the latest detected harmonic peak. Harmonic peak detector 40 outputs the peaks determined as harmonic peaks to voicing degree detector 70.

Figure 4A:
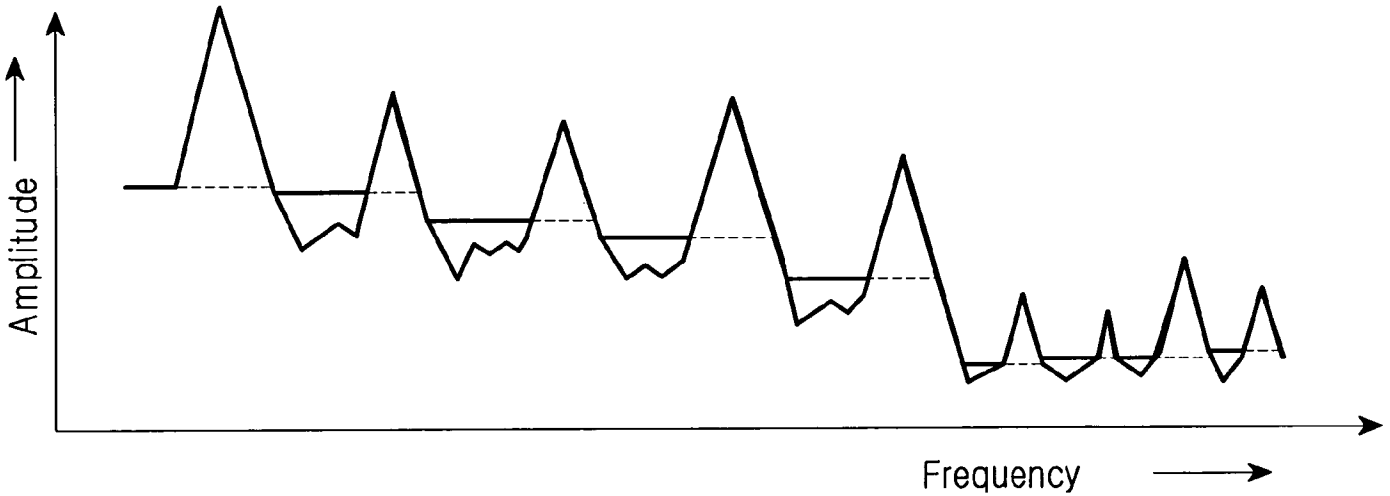
FIGS. 4A and 4B are waveform diagrams for explaining the process of performing a morphological operation according to the present invention.
Figure 4B:
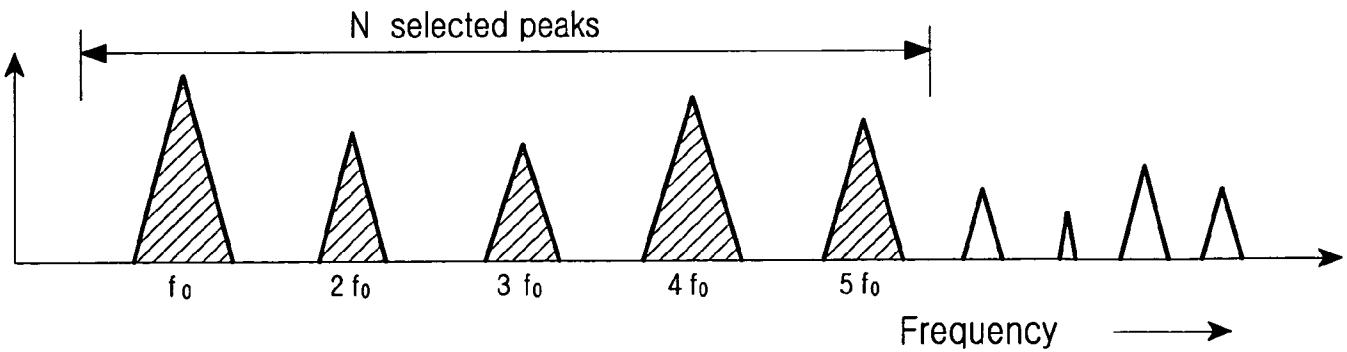

Morphological analyzer 60 includes a morphological filter 61 and a structured set size (SSS) determiner 62 and generates a signal waveform according to a morphological analysis of an input speech signal frame. Morphological filter 61 selects harmonic peaks through morphological closing. After performing the morphological closing, a waveform illustrated in FIG. 4A is obtained. If the waveform illustrated in FIG. 4A is pre-processed, a remainder (or residual) spectral waveform illustrated in FIG. 4B is obtained. The remainder spectrum indicates signals existing above a closure floor represented by the dotted line illustrated in FIG. 4A, and after the pre-processing, only characteristic frequency regions remain as illustrated in FIG. 4B. That is, after pre-processing, signals obtained by removing staircase signals from signals output after the morphological closing is performed are the signals illustrated in FIG. 4B. Through the pre-processing, harmonic content is emphasized in a voiced sound, and the major sinusoidal component is emphasized in an unvoiced sound.

In order to optimize the performance of morphological filter 61, it is necessary to determine how big a window size is needed to perform the morphological operation. That is, a morphological operation based on an optimal window size must be performed. To determine the optimal window size, SSS determiner 62 is included in morphological analyzer 61 in the current embodiment. SSS determiner 62 determines an SSS for optimizing the performance of morphological filter 61 and provides the determined SSS to morphological filter 61. A process of determining an SSS can be selectively used according to necessity, i.e., the SSS can be determined by default or by the method described below.

The process of determining an SSS will now be described. If it is assumed that the number of signals having the biggest harmonic peak, i.e., the number of the highest harmonic peaks, is N, that is, if N selected peaks corresponding to shaded areas of FIG. 4B are defined, a value P is calculated using the N selected peaks. Herein, P denotes a ratio of energy of the N selected peaks to energy of the remainder of the spectrum. For example, in FIG. 4B, if N=5, a value obtained by summing the shaded areas is the energy $E_N$ of the N selected peaks, and the energy of the remainder of the spectrum is $E_{total}$, $P=E_N/E_{total}$. The value P is compared to an SSS with no assumption regarding the signals, and if the value P is too large (e.g., SSS<0.5), N is decreased, and if the value P is too small (e.g., SSS>0.5), N is increased. Thus, since a speech signal has high pitches in the case of female speakers, the number of total harmonic peaks due to high pitches is small, and thus, a smaller N value is selected for female speakers as compared to male speakers. Through the above-described process, an optimal SSS of morphological filter 61, which performs the morphological closing of a waveform converted to a speech signal of the frequency domain, is determined. If the method of selecting SSS by adjusting N is not used, beginning from the smallest SSS and increasing it step by step may select an optimal SSS.

Since a morphological operation is a set-theoretical approach depending on fitting a structured element to a specific value, a one-dimensional image structured element, such as a speech signal waveform, is represented as a set of discrete values. Herein, a sliding window symmetrical to the origin determines a structured set, and the size of the sliding window determines the performance of the morphological operation.

According to the present invention, the window size is obtained by Equation (1).

$$\text{window size}=(\text{structured set size (SSS)}\times 2+1) \quad (1)$$

As shown in Equation 1, the window size depends on SSS. Thus, the performance of a morphological operation can be adjusted by adjusting the size of a structured set. Thus, morphological filter 61 can perform a morphological operation, such as dilation, erosion, opening, or closing, using a sliding window according to an SSS determined by SSS determiner 62.

Thus, morphological filter 61 performs a morphological operation with respect to the speech signal waveform in the frequency domain using the SSS determined by SSS determiner 62. That is, morphological filter 61 performs the morphological closing with respect to the converted speech signal waveform and performs the pre-processing.

A signal transforming method of morphological filter 61 is a nonlinear method in which geometric features of an input signal are partially transformed and has the effect of contraction, expansion, smoothing, and/or filling according to the four operations, i.e., erosion, dilation, opening, and closing. An advantage of this morphological filtering is that peak or valley information of a spectrum can be correctly extracted with a very small amount of computation. Furthermore, the morphological filtering is nonparametric. For example, unlike the conventional harmonic codec in which a harmonic structure of a speech signal is assumed, no assumption exists for an input signal in the present invention.

The morphological closing provides an effect of filling valleys between harmonic peaks in a speech signal spectrum, and thus, as illustrated in FIG. 4A, the harmonic peaks remain while small spurious peaks exist below the morphological closing spectrum.

Thus, morphological analyzer 60 can select only characteristic frequency regions included in the speech signal from a result of the morphological operation performed by morphological filter 61. That is, only the characteristic frequency regions can be selected by suppressing noise. All characteristic frequency regions for representing the speech signal are extracted by selecting all harmonic peaks including small harmonic peaks as illustrated in FIG. 4B. If the extracted characteristic frequency regions have the attribute of a voiced sound, harmonic peaks having constant periodicity, such as $f_0$, $2f_0$, $3f_0$, $4f_0$, $5f_0$, . . . , appear. That is, by applying the morphological scheme to the speech signal without distinguishing a voiced sound from an unvoiced sound, a characteristic frequency to be applied to a harmonic codec is extracted instead of a pitch frequency when the harmonic codec performs harmonic coding.

In particular, peaks remaining after performing the pre-processing in FIG. 4B appear due to a major sine wave component corresponding to the characteristic frequency of the speech signal. Unlike a general harmonic extraction method, the characteristic frequency is a frequency region of all sine waves represented in a speech signal.

Morphological analyzer 60 outputs the peak information of the harmonic peaks determined by the above-described process to voicing degree detector 70.

Voicing degree detector 70 detects the degree of voicing using the harmonic peak information input from harmonic peak detector 40, high-order peak detector 50, or morphological analyzer 60 and the pitch value input from pitch calculator 30.

While voiced sound has the correct pitch, an unvoiced sound has random pitches instead of the same pitch in the frequency domain. Thus, an interval between harmonic peaks of the unvoiced sound deviates from the pitch value. Voicing degree detector 70 detects a degree of voicing using the characteristic of a speech signal. That is, voicing degree detector 70 outputs a degree of voicing by comparing the previously calculated pitch value to an interval between adjacent harmonic peaks among harmonic peaks input from harmonic peak detector 40, high-order peak detector 50, or morphological analyzer 60 and generalizing a difference obtained from the comparison result.

According to the present invention, voicing degree detector 70 uses different equations when the degree of voicing is detected using harmonic peaks input from harmonic peak detector 40 or high-order peak detector 50 and when the degree of voicing is detected using harmonic peaks input from morphological analyzer 60.

When the degree of voicing is detected using harmonic peaks input from harmonic peak detector 40 or high-order peak detector 50, Equation (2) is used.

$$\frac{1}{N-1}\sum_{k=1}^{N-1}\left(\frac{P_{k+1}-P_k-f_0}{f_0}\right)^2 \tag{2}$$

In Equation (2), N denotes the number of peaks of a spectrum, $\{P_k\}$ denotes a harmonic peak input from harmonic peak detector 40 or high-order peak detector 50, and $1 \leqq k \leqq N$.

In this case, voicing degree detector 70 may detect the degree of voicing by receiving a predetermined weight from a weight module 71. Weight module 71 can weight the degree of voicing according to power of a peak amplitude. This can be represented by Equation (3).

$$\frac{1}{N-1}\sum_{k=1}^{N-1}(A_k)^{\gamma}\left(\frac{P_{k+1}-P_k-f_0}{f_0}\right)^2 \tag{3}$$

In Equation (3), $A_k$ denotes a weight.

When the degree of voicing is detected using harmonic peaks input from morphological analyzer 60, voicing degree detector 70 does not have to use a weight since almost peaks having a low level are removed in the morphological operation process. The degree of voicing detected using harmonic peaks input from morphological analyzer 60 can be represented by Equation (4).

$$M = \frac{1}{I}\sum_{k\in S}(A_k)^{\gamma}\left(\frac{P_k-K(k)f_0}{f_0}\right)^2 \tag{4}$$

In Equation 4, S denotes a set of the harmonic peaks input from morphological analyzer 60, I denotes the number of input harmonic peaks, and K(k) denotes an integer for minimizing $|P_k-K(k)f_0|$ (i.e., $K(k)f_0$ is harmonic of a pitch $f_0$ nearest to a peak). In this case, the amplitude weight $A_k$ is optional. In addition, when most harmonic peaks remain after the morphological pre-processing is performed, a simple pitch estimation value $$\hat{f}_0 = \frac{1}{I}\sum_{k\in S}P_k/k$$

can be used.

Speech processing unit 80 performs speech processing processes, such as speech coding, recognition, synthesis, and enhancement, using the degree of voicing input from voicing degree detector 70.

Figure 5:
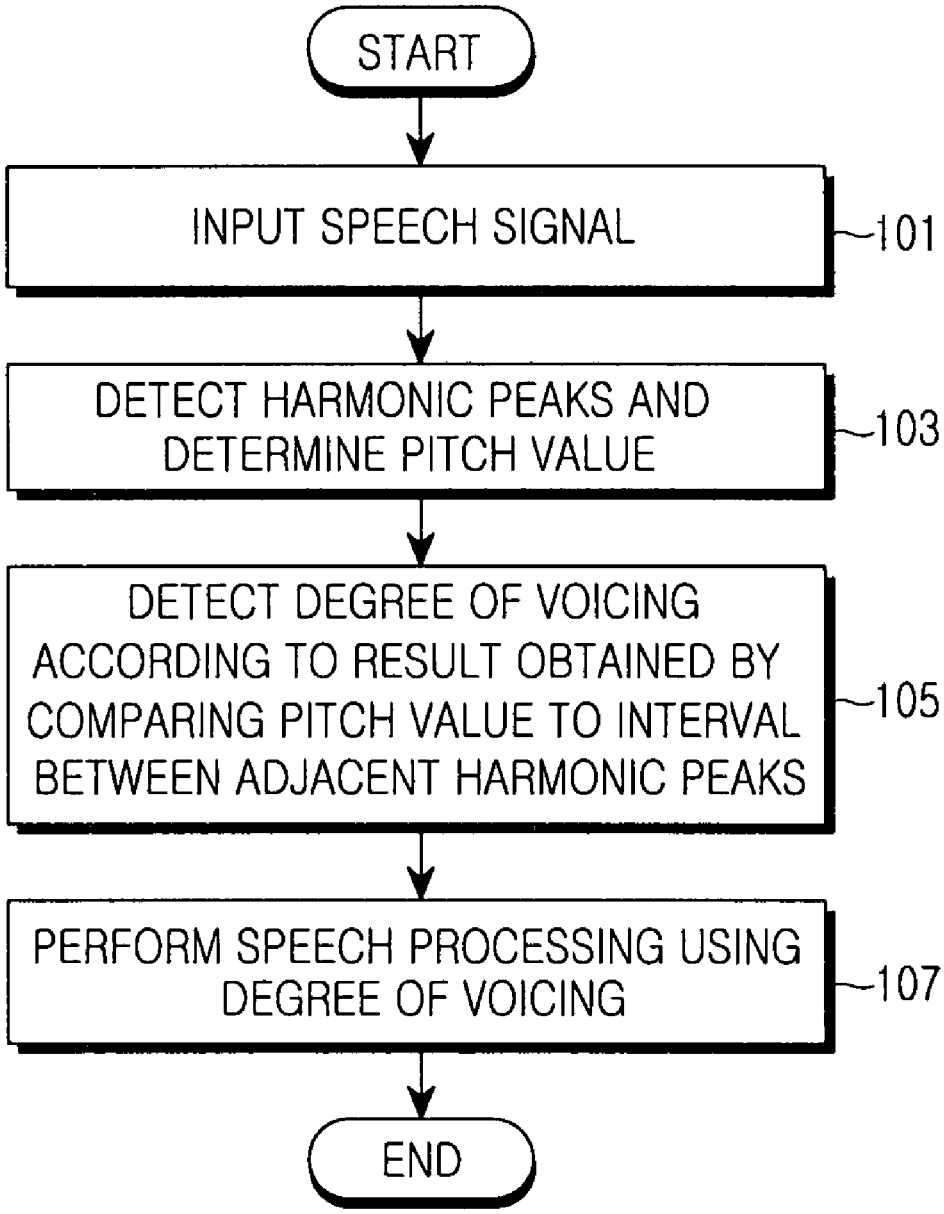
FIG. 5 is a flowchart of the method of detecting a degree of voicing of a speech signal according to the present invention.

The process of detecting a degree of voicing in the apparatus described above will now be described with reference to FIG. 5. Referring to FIG. 5, speech signal input unit 10 of the apparatus for detecting a degree of voicing outputs an input speech signal to frequency domain converter 20 in step 101, and frequency domain converter 20 converts the speech signal of the time domain to a speech signal of the frequency domain. The apparatus for detecting a degree of voicing calculates the pitch value using pitch calculator 30 and detects harmonic peaks using harmonic peak detector 40, high-order peak detector 50, and morphological analyzer 60 in step 103. The detection of harmonic peaks can be performed using one of harmonic peak detector 40, high-order peak detector 50, and morphological analyzer 60 or all of them according to the present invention. That is, the important thing in the present invention is harmonic peak information included in the speech signal, and any method can be used to detect harmonic peaks. Thus, considering accuracy of the degree of voicing, the apparatus for detecting a degree of voicing can be configured to detect correct harmonic peaks using at least two methods or detect harmonic peaks using one of the methods described above.

Voicing degree detector 70 of the apparatus for detecting a degree of voicing compares the pitch value to an interval between adjacent harmonic peaks and detects a degree of voicing according to the comparison result, i.e., a difference value, in step 105. Speech processing unit 80 of the apparatus for detecting a degree of voicing performs speech processing processes, such as speech coding, recognition, synthesis, and enhancement, using the detected degree of voicing in step 107.

While a general process of detecting a degree of voicing has been described, processes of detecting a degree of voicing according to harmonic peak detection methods included in the apparatus for detecting a degree of voicing will now be described.

A process of detecting a degree of voicing using harmonic peaks detected by high-order peak detector 50 will now be described with reference to FIG. 6.

Figure 6:
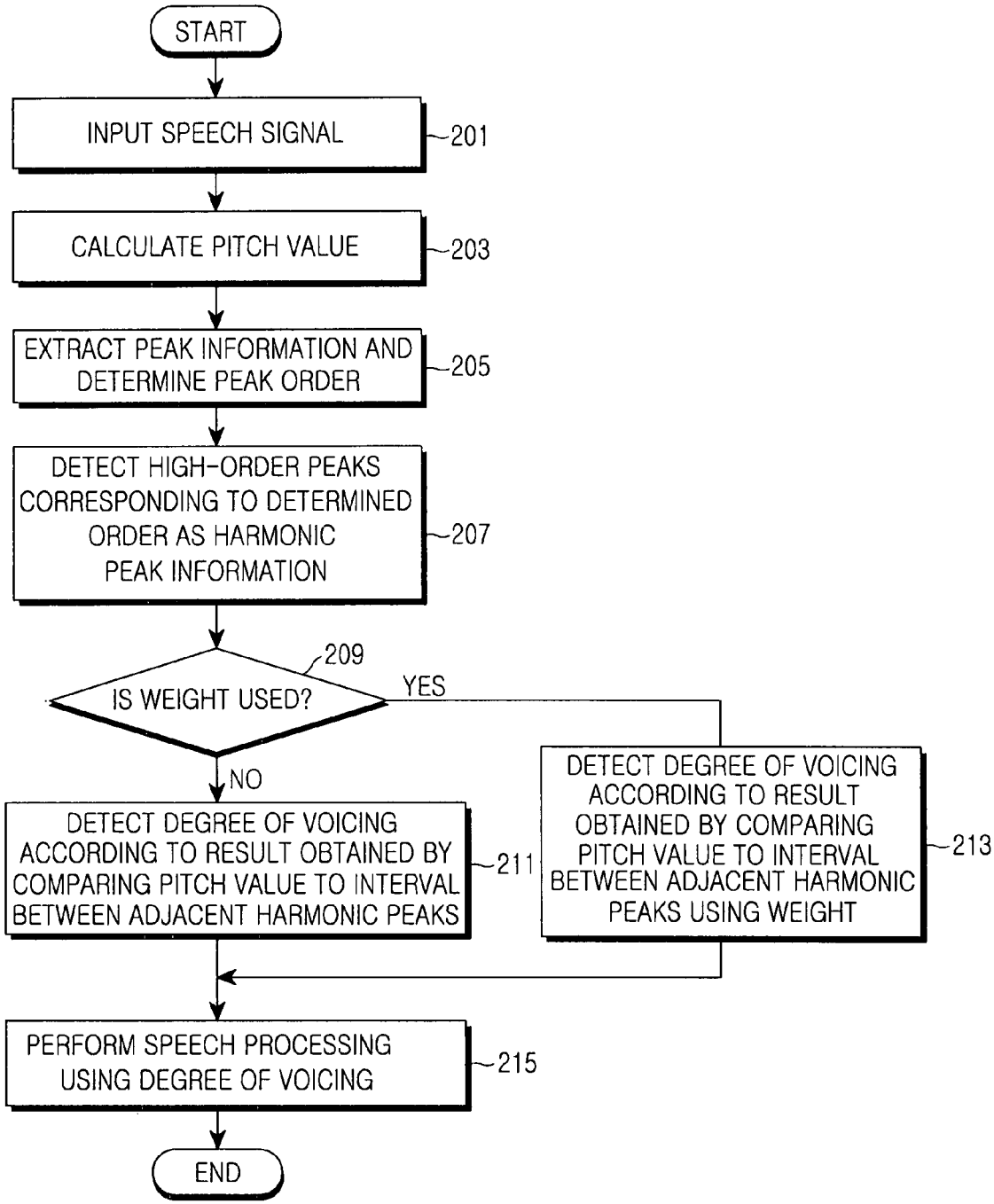
FIG. 6 is a flowchart of the method of detecting a degree of voicing of a speech signal according to the present invention.

Referring to FIG. 6, when a speech signal is input in step 201, speech signal input unit 10 of the apparatus for detecting a degree of voicing outputs the input speech signal to frequency domain converter 20, and frequency domain converter 20 converts the speech signal of the time domain to a speech signal of the frequency domain. The apparatus for detecting a degree of voicing calculates the pitch value using pitch calculator 30 in step 203. High-order peak detector 50 extracts peak information, determines a peak order in step 205, detects high-order peaks corresponding to the determined order as harmonic peak information in step 207, and outputs the detected harmonic peak information to voicing degree detector 70. Voicing degree detector 70 determines in step 209 whether a weight input from the weight module 71 is used. If it is determined in step 209 that the weight is not used, voicing degree detector 70 compares the pitch value to an interval between adjacent harmonic peaks and detects a degree of voicing according to the comparison result, i.e., a difference value, in step 211. In this case, voicing degree detector 70 calculates the degree of voicing using Equation 2. If it is determined in step 209 that the weight is used, voicing degree detector 70 compares the pitch value to an interval between adjacent harmonic peaks using the weight and detects a degree of voicing according to the comparison result, i.e., a difference value, in step 213. In this case, voicing degree detector 70 calculates the degree of voicing using Equation 3. The apparatus for detecting a degree of voicing performs speech processing using the detected degree of voicing in step 215.

A process of detecting a degree of voicing using harmonic peaks detected by harmonic peak detector 40 will now be described with reference to FIG. 7.

Figure 7:
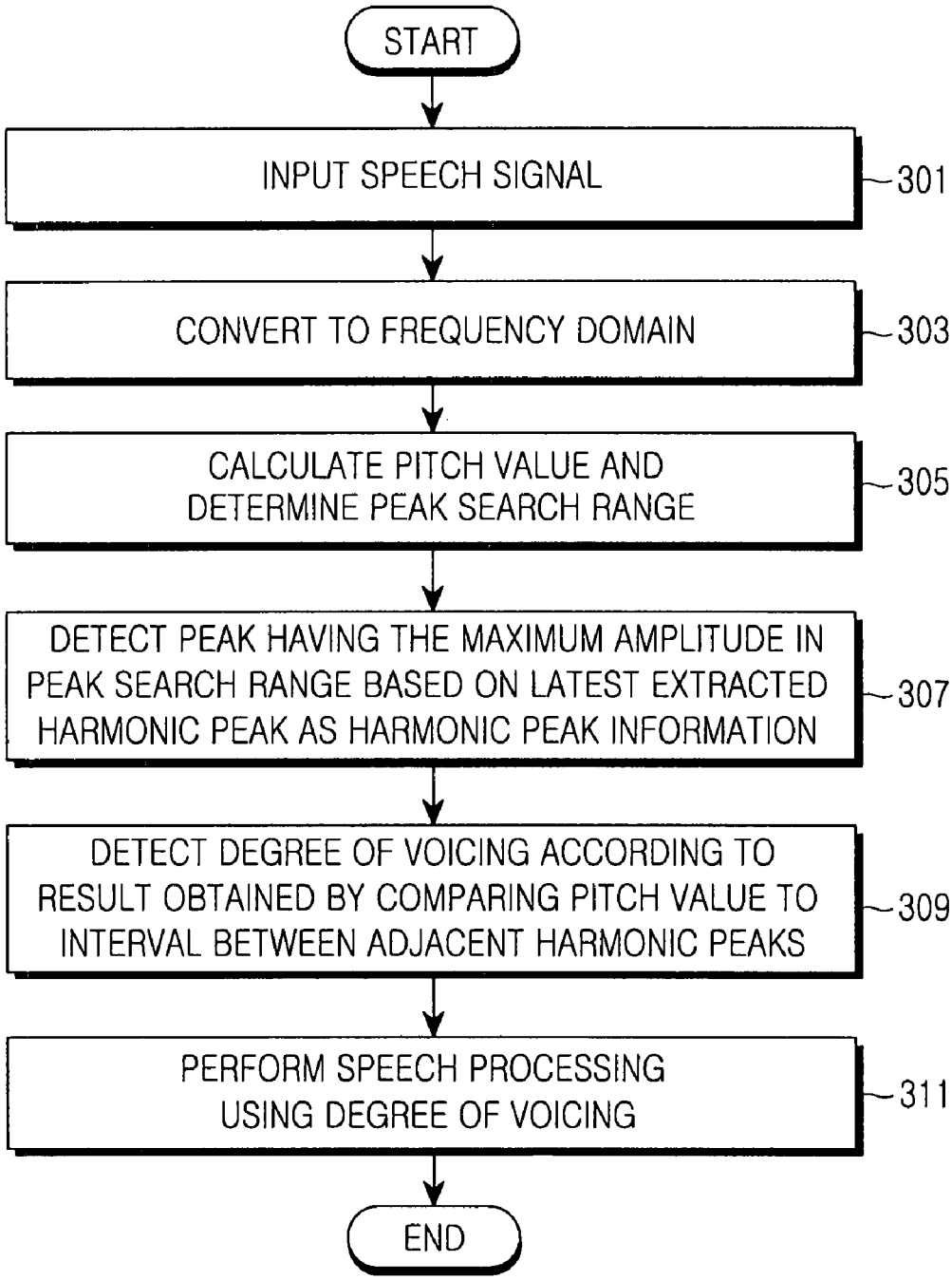
FIG. 7 is a flowchart of the method of detecting a degree of voicing of a speech signal according to the present invention.

Referring to FIG. 7, when a speech signal is input in step 301, speech signal input unit 10 of the apparatus for detecting a degree of voicing outputs the input speech signal to frequency domain converter 20. Frequency domain converter 20 converts the speech signal of the time domain to a speech signal of the frequency domain in step 303. The apparatus for detecting a degree of voicing calculates the pitch value using pitch calculator 30 and determines a peak search range using harmonic peak detector 40 in step 305. Harmonic peak detector 40 detects a peak having the maximum amplitude in the peak search range based on the latest detected harmonic peak as harmonic peak information and outputs the detected harmonic peak information to voicing degree detector 70 in step 307. Voicing degree detector 70 determines in step 309 whether a weight input from weight module 71 is used. Using the weight or not according to the determination result, voicing degree detector 70 compares the pitch value to an interval between adjacent harmonic peaks and detects a degree of voicing according to the comparison result, i.e., a difference value. In this case, voicing degree detector 70 calculates the degree of voicing using Equation 2 or 3. The apparatus for detecting a degree of voicing performs speech processing using the detected degree of voicing in step 311.

A process of detecting a degree of voicing using harmonic peaks detected by the morphological analyzer 60 will now be described with reference to FIG. 8.

Figure 8:
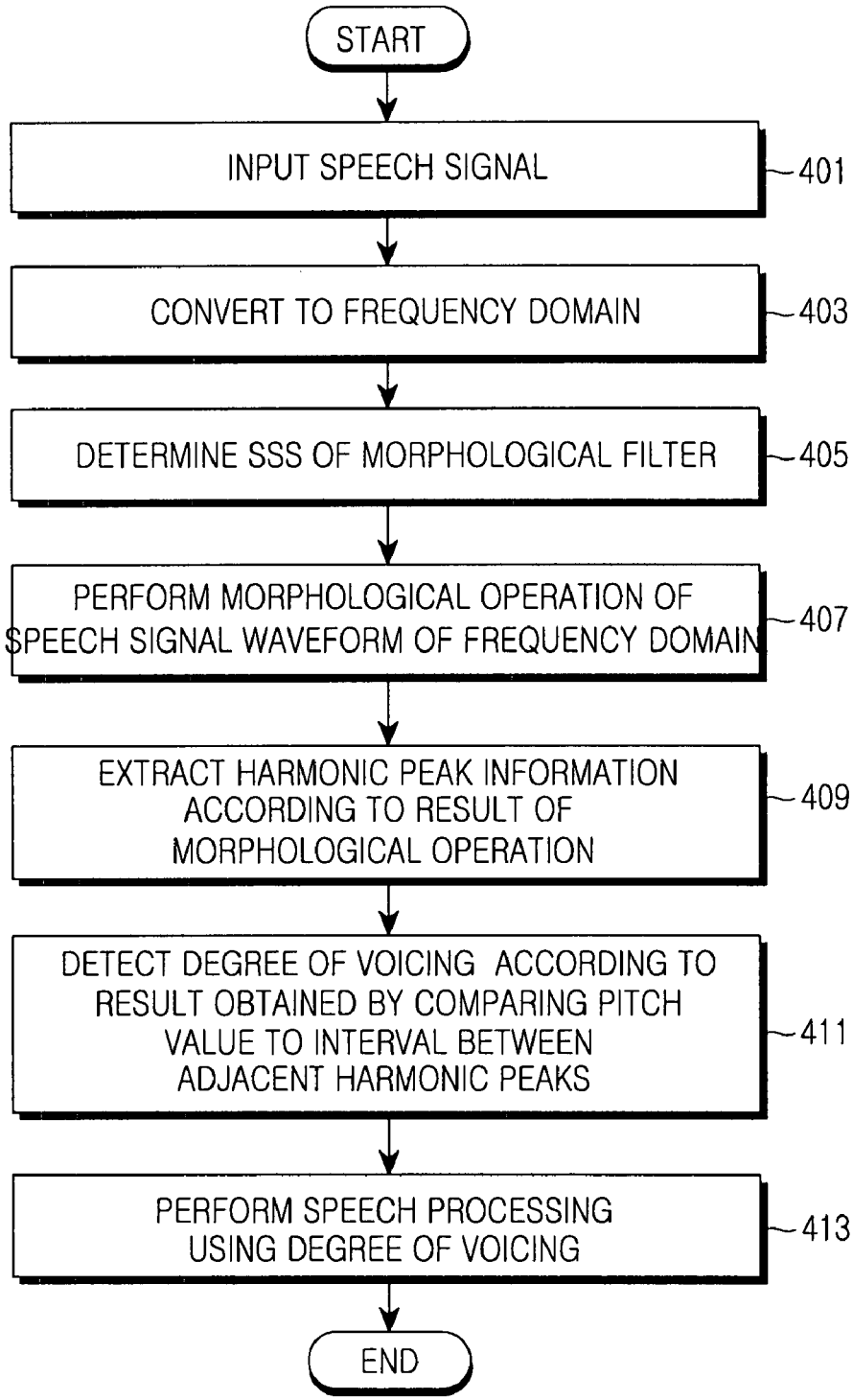
FIG. 8 is a flowchart of the method of detecting a degree of voicing of a speech signal according to the present invention.

Referring to FIG. 8, when a speech signal is input to speech signal input unit 10 in step 401, the apparatus for detecting a degree of voicing outputs the input speech signal to frequency domain converter 20 and converts the speech signal of the time domain to a speech signal in the frequency domain using frequency domain converter 20 in step 403, and calculates the pitch value using pitch calculator 30. The apparatus for detecting a degree of voicing determines the SSS of morphological filter 61 using morphological analyzer 60 in step 405 and performs a morphological operation with respect to the speech signal waveform of the frequency domain in step 407. Morphological analyzer 60 extracts harmonic peak information as a result of the morphological operation and outputs the extracted harmonic peak information to voicing degree detector 70 in step 409. Voicing degree detector 70 compares the pitch value to an interval between adjacent harmonic peaks and detects a degree of voicing according to the comparison result, i.e., a difference value in step 411. In this case, voicing degree detector 70 calculates the degree of voicing using Equation 4. The apparatus for detecting a degree of voicing performs speech processing using the detected degree of voicing in step 413.

As described above, the present invention provides the apparatus and method for detecting a degree of voicing that is the most important information requisitely used in all systems using speech and audio signals, the performance limitation and problems of the conventional methods can be solved using harmonic peak analysis.

The method is a very quick, correct, and practical method with robustness to noise requiring a very small amount of computation by analyzing and using a harmonic region always existing high above the noise level and can provide voiced information requisite to all speech and audio signals.

Since the degree of voicing suggested in the present invention is obtained by measuring the amplitude of a harmonic component of a speech and/or audio signal, the essential attribute in voiced and unvoiced separation feature extraction can be numerically expressed. i.e., an attribute that "voiced speech is quasi-periodic due to semi-regular glottal excitation and unvoiced speech has noise-like excitation." Thus, compared to the conventional methods in which various features are extracted and combined, the method of detecting a degree of voicing is practical, simple, very correct, and efficient.

In addition, the harmonic peak separation and analysis techniques of the method of detecting a degree of voicing, which is provided in the present invention, can be applied to many other speech and audio feature extraction methods and can distinguish a voiced sound from an unvoiced sound much more correctly by being used together with other conventional feature extraction methods (e.g., combination of features using an artificial neural network).

The usefulness of the method of detecting a degree of voicing significantly increases based on analysis of major harmonic regions, and its performance can be better by emphasizing the frequency domain, which is important to distinguish a voiced sound from an unvoiced sound.

While the invention has been shown and described with reference to a certain preferred embodiment thereof, it will be understood by those skilled in the art that various changes in form and details may be made therein without departing from the spirit and scope of the invention as further defined by the appended claims.

What is claimed is:

1. A method of detecting a degree of voicing of a speech signal by a voice processing device, the method comprising the steps of:

converting, by the voice processing device, a received time domain speech signal to a speech signal in frequency domain;

calculating a pitch value from the speech signal;

detecting a plurality of harmonic peaks existing in the speech signal; and detecting a difference, which is obtained by comparing a distance between adjacent harmonic peaks among the detected harmonic peaks to the pitch value, as a degree of voicing indicating a ratio of a voiced sound included in the speech signal.

2. The method of claim 1, wherein the step of detecting a plurality of harmonic peaks comprises:

extracting peak information existing in the speech signal;

determining an order based on the extracted peak information; and detecting high-order peaks corresponding to the determined order as harmonic peaks.

3. The method of claim 1, wherein the step of detecting a plurality of harmonic peaks comprises:

determining a peak search range using the pitch value; and setting a plurality of peak search ranges in the speech signal, detecting peaks existing in each of the set peak search ranges, determining a peak having the maximum spectral value among the detected peaks, and detecting the determined peak as a harmonic peak of the speech signal.

4. The method of claim 2, wherein in the step of detecting a degree of voicing, the degree of voicing is calculated using the Equation below $$\frac{1}{N-1}\sum_{k=1}^{N-1}\left(\frac{P_{k+1}-P_k-f_0}{f_0}\right)^2,$$

where N denotes the number of peaks of a spectrum, $\{P_k\}$ denotes a harmonic peak, $f_0$ denotes the pitch value, and $1 \leqq k \leqq N$.

5. The method of claim 2, wherein in the step of detecting a degree of voicing, the degree of voicing is calculated using the Equation below $$\frac{1}{N-1}\sum_{k=1}^{N-1}(A_k)^{\gamma}\left(\frac{P_{k+1}-P_k-f_0}{f_0}\right)^2,$$

where N denotes the number of peaks of a spectrum, $\{P_k\}$ denotes a harmonic peak, $f_0$ denotes the pitch value, $1 \leqq k \leqq N$, $A_k$ denotes a weight, and y denotes a constant.

6. The method of claim 1, wherein the step of detecting a plurality of harmonic peaks comprises:

determining a structured set size (SSS) of a morphological filter; and performing a morphological operation of the speech signal waveform and detecting harmonic peaks according to a result of the morphological operation.

7. The method of claim 6, wherein in the step of detecting a degree of voicing, the degree of voicing is calculated using the Equation below $$M=\frac{1}{I}\sum_{k\in S}(A_k)^{\gamma}\left(\frac{P_k-K(k)f_0}{f_0}\right)^2,$$

where M denotes the degree of voicing, $A_k$ denotes a weight, y denotes a constant, $\{P_k\}$ denotes a harmonic peak, S denotes a set of the harmonic peaks, I denotes the number of harmonic peaks, and K(k) denotes an integer for minimizing $|P_k-K(k)f_0|$, and $f_0$ denotes the pitch value.

8. An apparatus for detecting a degree of voicing of a speech signal, the apparatus comprising:

a frequency domain converter for converting a received time domain speech signal to a speech signal of a frequency domain;

a pitch calculator for calculating a pitch value from the speech signal;

a harmonic peak determiner for detecting a plurality of harmonic peaks existing in the speech signal; and a voicing degree detector for detecting a difference, which is obtained by comparing a distance between adjacent harmonic peaks among the detected harmonic peaks to the pitch value, as a degree of voicing indicating a ratio of a voiced sound included in the speech signal.

9. The apparatus of claim 8, wherein the harmonic peak determiner extracts peak information existing in the speech signal, determines an order based on the extracted peak information, and detects high-order peaks corresponding to the determined order as harmonic peaks.

10. The apparatus of claim 8, wherein the harmonic peak determiner determines a peak search range using the pitch value, sets a plurality of peak search ranges in the speech signal, detects peaks existing in each of the set peak search ranges, determines a peak having the maximum spectral value among the detected peaks, and detects the determined peak as a harmonic peak of the speech signal.

11. The apparatus of claim 9, wherein the voicing degree detector calculates the degree of voicing using the Equation below $$\frac{1}{N-1}\sum_{k=1}^{N-1}\left(\frac{P_{k+1}-P_k-f_0}{f_0}\right)^2,$$

where N denotes the number of peaks of a spectrum, $\{P_k\}$ denotes a harmonic peak, $f_0$ denotes the pitch value, and $1 \leqq k \leqq N$.

12. The apparatus of claim 9, wherein the voicing degree detector calculates the degree of voicing using the Equation below $$\frac{1}{N-1}\sum_{k=1}^{N-1}(A_k)^{\gamma}\left(\frac{P_{k+1}-P_k-f_0}{f_0}\right)^2,$$

where N denotes the number of peaks of a spectrum, $\{P_k\}$ denotes a harmonic peak, $f_0$ denotes the pitch value, $1 \leqq k \leqq N$, $A_k$ denotes a weight, and y denotes a constant.

13. The apparatus of claim 8, wherein the harmonic peak determiner determines a structured set size (SSS) of a morphological filter, performs a morphological operation of the speech signal waveform, and detects harmonic peaks according to a result of the morphological operation.

14. The apparatus of claim 13, wherein the voicing degree detector calculates the degree of voicing using the Equation below $$M = \frac{1}{I}\sum_{k\in S}(A_k)^{\gamma}\left(\frac{P_k - K(k)f_0}{f_0}\right)^2,$$

where M denotes the degree of voicing, $A_k$ denotes a weight, y denotes a constant, $\{P_k\}$ denotes a harmonic peak, S denotes a set of the harmonic peaks, I denotes the number of harmonic peaks, and K(k) denotes an integer for minimizing $|P_k - K(k)f_0|$, and $f_0$ denotes the pitch value.

* * * * *